United States Patent [19]

Doran et al.

[11] Patent Number: 5,014,376

[45] Date of Patent: May 14, 1991

[54] APPARATUS FOR HOLDING AND SUPPORTING AN INFANT

[76] Inventors: Cheryl C. Doran; Arthur J. Doran, both of 6038 S. Sawyer, Chicago, Ill. 60629

[21] Appl. No.: 498,229

[22] Filed: Mar. 23, 1990

[51] Int. Cl.[5] ..... A47D 7/00; A47G 9/04

[52] U.S. Cl. ..... 5/431; 5/494

[58] Field of Search ..... 5/431, 424, 494, 99 R, 5/482, 434, 436, 496, 498; 2/69

[56] References Cited

U.S. PATENT DOCUMENTS

| | | | |
|---|---|---|---|
| 1,368,582 | 2/1921 | Stevens . | |
| 1,432,875 | 10/1922 | Lavagetto | 5/431 |
| 2,024,050 | 8/1934 | May . | |
| 2,710,052 | 6/1955 | Witmer | 297/468 |
| 3,066,321 | 4/1960 | Kintner . | |
| 3,083,378 | 4/1963 | Pursell | 5/494 |
| 3,292,611 | 12/1966 | Belkin | 5/101 |
| 3,308,490 | 9/1965 | Cacioppo . | |
| 3,376,585 | 4/1968 | Muzaurieta | 5/462 |
| 3,578,383 | 3/1969 | Earl | 297/391 |
| 3,857,124 | 12/1974 | Hadley | 5/494 |
| 4,241,466 | 12/1980 | Mendyk | 5/494 |
| 4,276,667 | 7/1981 | Osbourne | 5/498 |
| 4,301,561 | 11/1981 | McLeod | 5/496 |
| 4,383,713 | 5/1983 | Roston | 297/219 |
| 4,606,087 | 8/1986 | Alivizatos | 5/424 |
| 4,646,375 | 3/1987 | Parker | 5/498 |
| 4,667,356 | 5/1987 | Holmquist | 5/431 |
| 4,712,258 | 12/1987 | Eves | 5/424 |
| 4,761,032 | 8/1988 | Sanchez et al. | 297/229 |
| 4,773,108 | 9/1988 | Leever | 5/504 |
| 4,802,244 | 2/1989 | McGrath-Saleh | 2/69 |
| 4,802,249 | 2/1989 | Bills | 5/420 |
| 4,829,617 | 5/1989 | Dameron | 5/498 |
| 4,833,744 | 5/1990 | Correa | 5/496 |
| 4,862,535 | 9/1989 | Roberts | 5/431 |

*Primary Examiner*—Alexander Grosz

*Attorney, Agent, or Firm*—Lockwood, Alex, FitzGibbon & Cummings

[57] ABSTRACT

An apparatus for supporting and securely holding an infant is disclosed. In its preferred embodiment, the apparatus includes a wedge-shaped resilient support member having an inclined surface for supporting an infant thereon. A blanket is provided which is releasably attachable to the support member and which can be wrapped around the infant when positioned on the inclined surface of the support member. Preferably, the blanket can be releasably attached to the bottom of the support member and wrapped around the support member and the infant to provide the comfort, warmth and security similar to that which an infant would experience when held in someone's arms. A music box may be affixed to or mounted within the support member to play music such as a lullaby and the like.

4 Claims, 1 Drawing Sheet

APPARATUS FOR HOLDING AND SUPPORTING AN INFANT

BACKGROUND AND BRIEF DESCRIPTION OF THE INVENTION

The present invention generally relates to an apparatus for supporting and holding an infant. More specifically, the invention relates to an apparatus which provides a support surface upon which an infant may be securely held so that the infant's head is elevated above his or her feet. The apparatus of the present invention provides a means for holding an infant on the support surface so that he or she can be securely supported while the child care provider is free to perform other tasks.

Those familiar with the art will appreciate that child care devices have been provided to generally secure the safety of a child while providing some means of support and allowing the child's parent or care provider to attend to the child. Such devices often include restraints to prevent the child from moving and to avoid injury. For example, car seats or carriers and the like are generally provided with straps to prevent an infant or toddler from climbing out of the seat or carrier while also preventing injury in the event of collision. Changing mats or changing tables have been provided with restraints so that the infant won't roll off the table or mat and be injured if left momentarily unattended. However, the art has generally failed to provide an apparatus which can be used by a parent or infant care provider to simulate the nurturance, warmth and the support which an infant experiences when being held in someone's arms.

The present invention overcomes the shortcomings of the art with an apparatus for providing a comfortable and secure support for newborn infants which simulates the support, comfort and security experienced by the infant when held in someone's arms. The apparatus of the present invention includes a support member dimensioned to provide an inclined support surface for the placement of an infant thereon. Restraining means, preferably in the form of a wrap or blanket, are provided to hold the infant on the support member and are releasably attached to the support member with attachment means in the form of Velcro strips, snaps, buttons, zippers and the like.

In its preferred form, the present invention securely and comfortably holds the infant between a blanket and a resilient support member by releasably affixing the blanket to the support member. In the arrangement of parts described herein, the infant's head is maintained at a preferred 30° elevation when the infant is properly positioned on the support member. The invention allows the parent or care provider to provide the infant with necessary nurturance while also freeing the care provider for other tasks. The apparatus simulates the warmth, comfort and snugness which the infant experiences when held in someone's arms.

It is accordingly an object of the present invention to provide an apparatus for supporting and securely holding an infant.

It is another object of the present invention to provide an apparatus for supporting and securely holding an infant and wherein the apparatus is easy to use as well as being inexpensive and simple to manufacture.

It is still another object of the present invention to provide an apparatus for supporting and securely holding an infant on a resilient support member wherein the infant's head is elevated when positioned on such a resilient support member.

These and other objects and advantages of the present invention will be apparent to those skilled in the art upon further consideration of the remainder of the disclosure including the drawings and the detailed description of the preferred embodiment.

DETAILED DESCRIPTION OF THE PREFERRED EMBODIMENT

An apparatus for supporting and securely holding an infant is provided which, in a preferred embodiment, includes a support member in the form of a resilient foam wedge. An infant may be positioned on the inclined surface of the wedge to elevate the infant's head at a preferred angle and above the infant's feet. Restraining means in the form of a blanket may be wrapped around the infant. The blanket, or its equivalent, may be releasably attached to the support member to secure the infant on the inclined surface of the support member. A music box or equivalent means for playing music may be affixed to the apparatus to provide music such as a lullaby, for example.

Figure 1:
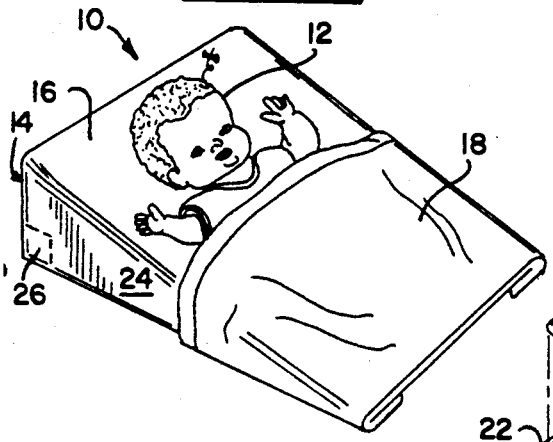
FIG. 1 is a perspective view of an apparatus for holding and supporting an infant in accordance with the present invention and illustrating the apparatus in use.

Referring now to the drawings, FIG. 1 is illustrative of the apparatus 10 in use, showing all of its component pieces in operative association. As shown, an infant 12 can be positioned on a support member 14 to support the infant, when positioned on his or her back, so that the infant's head is elevated at an incline of approximately 30°. The support member 14 is preferably provided as a unitary resilient foam wedge which will provide adequate support for the infant 12 while also providing a measured degree of comfort. Most preferably, the support member 14 is provided as a resilient foam wedge which is wrapped in a netting material (not shown) to extend the life of the foam wedge. An outer covering of material 16 will preferably encompass the member 14. Most preferably, the material 16 is flame retardant for safety and may also be provided in a variety of colors and with various designs to enhance its appearance.

Figure 2:
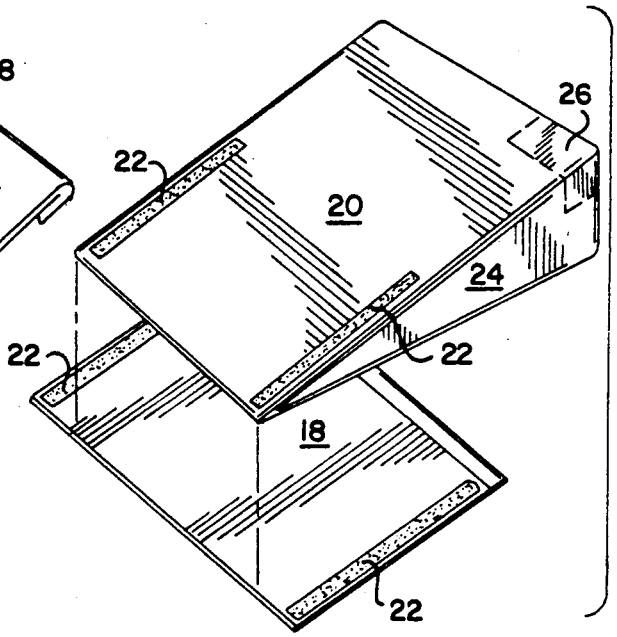
FIG. 2 is a perspective view, partially exploded, of an apparatus for holding and supporting an infant in accordance with the present invention and viewing the apparatus from its bottom surface.

Restraining means are provided to secure the infant 12 to the support member. Preferably, the restraining means are provided in the form of a releasably attachable blanket 18 which may be secured to the bottom surface 20 of the support member 14. Attachment means in the form of snaps, buttons, zippers and the like are provided to releasably secure the blanket 18 to the support member 14. Most preferably, the attachment means are provided in the form fastener strips 22 of the type which are made of fabric and which can be fastened to each other such as those known under the trademark VELCRO, for example. Mating halves of the strips 22 are secured to the bottom surface 20 of the support member 14 and to the underside of the blanket 18, substantially as shown in FIG. 2. In this arrangement of parts, the infant 12 can be positioned on the support member 14, substantially as shown in FIG. 1, with the blanket 18 wrapped around the infant and secured to the bottom surface 20 of the support member 14 by attaching the mating members of the strips 22. In this manner, the infant 12 will be secured within the apparatus 10 and will be unable to move off of the inclined surface of the support member 14. The resilient material of the support member 14 provides comfort and security to the infant while the blanket 18 provides a measured degree of warmth as well as security with the overall effect of simulating the nurturance and comfort which the infant would experience when held in someone's arms. Although it is contemplated that the fastener strips 22 provide the most efficient means to releasably attach the blanket 18 to the support member 14, any means for securing the blanket 18 to the support member 14 are contemplated within the scope of this invention.

The blanket 18 is preferably dimensioned to wrap around the sides 24 of the support member 14 to prevent drafts and the like from entering underneath the blanket. Accordingly, the attachment means are preferably and most conveniently positioned on the outermost edges of the blanket 18 as well as the bottom surface 20 of the support member 14. It will be appreciated that the attachment means can also be positioned at other locations on both the support member 14 and the blanket 18. Any placement of the attachment means which allows for the blanket 18 to be attached to the support member 14 are contemplated as being within the scope of this invention.

Figure 3:
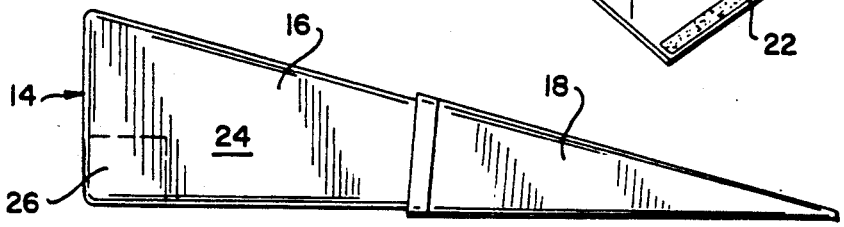
FIG. 3 is a side elevational view of the apparatus of FIG. 1.
Figure 4:
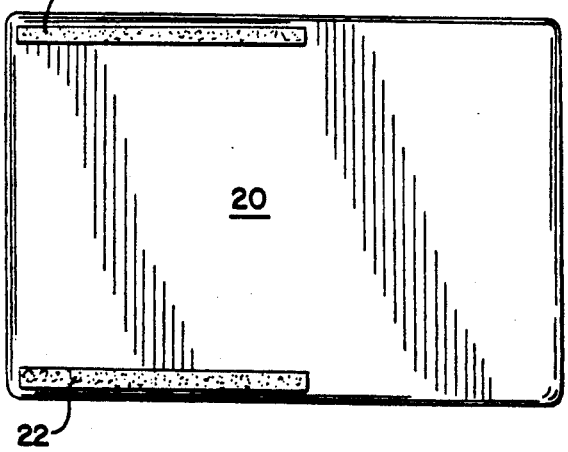
FIG. 4 is a bottom plan view showing the support member of an apparatus in accordance with the present invention.
Figure 5:
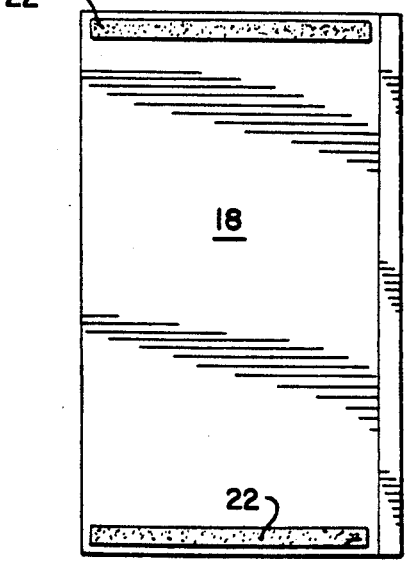
FIG. 5 is a bottom plan view of the restraining means of an apparatus in accordance with the present invention.

A music box 26 may also be affixed to or mounted within the support member 14, substantially as illustrated in FIGS. 1–3. In this manner, the infant can be lulled to sleep by a song such as a lullaby and the like. Any means for playing music such as a music box, a tape recorder or the like can be provided and it is not intended that the invention be limited to including only a music box 26.

Regarding materials and dimensions, the support member 14 may be made from any resilient foam material and is preferably dimensioned to have a length on its bottom surface 20 of approximately twenty-three inches and a width of approximately sixteen inches. The inclined surface on the support member 14 is preferably provided at a 30° incline, sloping upwardly to a uppermost position of approximately thirteen to fourteen inches above the bottom surface 20. The blanket 18 should be compatibly dimensioned for use in the manner described herein with the support member 14 to cover an infant positioned thereon. A blanket having a length of about thirteen inches and a width of about twenty-two inches has been suitable. Fastener strips 22, provided on the bottom surface 20 or support member 14 and blanket 18 should be of a sufficient length to adequately secure an infant 12 between blanket 18 and the inclined surface of the support member. In this regard, fastener strips having a length of about thirteen inches have been suitable.

An apparatus constructed according to the principles of the present invention is most useful in the care of newborn infants and infants less than about 3–4 months of age.

While a preferred embodiment of the present invention has been discussed and described in detail, those skilled in the art will appreciate that various changes and modifications can be made to the preferred embodiment without departing from the true spirit and scope of the invention, as defined in the following claims.

We claim:

1. An apparatus for supporting and securely holding an infant, comprising:

a resilient wedge-shaped support member, said support member having an inclined support surface for the placement of an infant thereon, said support surface having a first lateral edge and a second lateral edge;

a blanket releasably attachable to said wedge-shaped support member for holding an infant on said inclined surface of said support member, said blanket being dimensioned to extend laterally beyond said first lateral edge and said second lateral edge when said blanket is attached to said support member; and attachment means positioned on the bottom surface of said support member and adapted to cooperate with attachment means positioned on the lateral edge portions of said blanket, to releasably attach said blanket to the bottom surface of said wedge-shaped support member;

whereby, said blanket covers the lower portion of an infant's body when the infant is placed on said support surface and said blanket is attached to said support member.

2. The apparatus as defined in claim 1, wherein said support member provides said inclined surface at a 30° angle with respect to the bottom surface of said support member.

3. The apparatus as defined in claim 1 further comprising means for playing music associated with said support member.

4. The apparatus as defined in claim 1, wherein said attachment means are fabric fastener strips, said fastener strips being of the type known under the trademark VELCRO, said fastener strips being provided on the edges of said blanket and on the bottom surface of said wedge-shaped support member such that said blanket may be releasably secured to said support member to hold an infant thereon.

* * * * *